US009951914B1

(12) United States Patent
Farnsworth

(10) Patent No.: US 9,951,914 B1
(45) Date of Patent: Apr. 24, 2018

(54) LIGHT SYSTEM AND METHOD OF INSTALLING

(71) Applicant: SYSTEM LIGHTING SOLUTIONS, LLC, Riverton, UT (US)

(72) Inventor: Tye T. Farnsworth, Riverton, UT (US)

(73) Assignee: SYSTEM LIGHTING SOLUTIONS, LLC, Riverton, UT (US)

( * ) Notice: Subject to any disclaimer, the term of this patent is extended or adjusted under 35 U.S.C. 154(b) by 0 days.

(21) Appl. No.: 15/364,152

(22) Filed: Nov. 29, 2016

Related U.S. Application Data

(63) Continuation of application No. 14/662,991, filed on Mar. 19, 2015, now Pat. No. 9,506,609.

(Continued)

(51) Int. Cl.

| | |
|---|---|
| ***F21V 1/00*** | (2006.01) |
| ***F21S 4/20*** | (2016.01) |
| ***F21V 31/00*** | (2006.01) |
| ***F21V 3/00*** | (2015.01) |
| ***F21V 23/00*** | (2015.01) |
| ***F21V 23/02*** | (2006.01) |
| ***F21V 15/01*** | (2006.01) |
| ***F21V 23/06*** | (2006.01) |

(Continued)

(52) U.S. Cl.

CPC ..... *F21S 4/20* (2016.01); *F21S 2/005* (2013.01); *F21V 3/00* (2013.01); *F21V 15/01* (2013.01); *F21V 23/001* (2013.01); *F21V 23/003* (2013.01); *F21V 23/02* (2013.01); *F21V 23/06* (2013.01); *F21V 31/005* (2013.01); *H05B 33/0863* (2013.01); *F21V 33/006* (2013.01); *F21W 2121/00* (2013.01); *F21Y 2103/10* (2016.08); *F21Y 2113/13* (2016.08); *F21Y 2115/10* (2016.08)

(58) Field of Classification Search

CPC ..... F21S 4/001; F21S 2/008; F21V 23/001; F21V 23/003; F21V 31/005; H05B 33/086; F21Y 2103/003; F21Y 2113/005

See application file for complete search history.

(56) References Cited

U.S. PATENT DOCUMENTS 2,784,812 A * 3/1957 Kindorf ..... A47B 96/1475 211/182

3,204,090 A * 8/1965 Kvarda, Jr. ..... F21S 4/20 362/249.01

(Continued)

*Primary Examiner* — Ali Alavi

(74) *Attorney, Agent, or Firm* — Morriss O'Bryant Compagni Cannon, PLLC

(57) ABSTRACT

A lighting system includes a first elongate channel configured for mounting to a structure, a second elongate channel configured for being temporarily coupled to the first elongate channel and forming a substantially enclosed elongate space between the first and second elongate channels. A plurality of led lights, each having a translucent watertight housing, at least one led and a integrated circuit within the translucent housing, are coupled to the second elongate channel with each of the translucent watertight housings exposed through the second elongate channel. A controller is electrically connected to a plurality of segments of wire to communicate with each of the plurality of integrated circuits and has a plurality of programmable functions, each function providing at least one of a desired light color for each of the plurality of led lights, duration of illumination and timing of illumination.

20 Claims, 13 Drawing Sheets

Related U.S. Application Data

(60) Provisional application No. 61/955,308, filed on Mar. 19, 2014.

(51) Int. Cl.

| | |
|---|---|
| ***H05B 33/08*** | (2006.01) |
| ***F21S 2/00*** | (2016.01) |
| *F21Y 115/10* | (2016.01) |
| *F21V 33/00* | (2006.01) |
| *F21W 121/00* | (2006.01) |
| *F21Y 103/10* | (2016.01) |
| *F21Y 113/13* | (2016.01) |

(56) References Cited

U.S. PATENT DOCUMENTS 3,500,036 A * 3/1970 Szentveri ..... F21S 4/20 362/152
3,692,993 A * 9/1972 Robinson ..... F21S 8/028 362/249.07
4,482,944 A * 11/1984 Roossine ..... F21V 19/0005 362/220
4,774,646 A * 9/1988 L'Heureux ..... F21S 2/005 362/145
5,067,061 A 11/1991 Prickett
5,084,806 A 1/1992 Nagai
D350,312 S 9/1994 Edwards
D350,313 S 9/1994 Edwards
5,469,344 A 11/1995 Kotsakis
D374,737 S 10/1996 Can
5,594,628 A 1/1997 Reuter et al.
D384,763 S 10/1997 Roorda
5,707,136 A 1/1998 Byers
D397,818 S 9/1998 Herst
5,813,751 A 9/1998 Shaffer
5,816,687 A 10/1998 Tapp
5,927,041 A 7/1999 Sedlmeier et al.
6,033,088 A 3/2000 Contigiani
6,050,703 A 4/2000 Herbert
6,050,709 A * 4/2000 Hastings ..... F21V 17/007 362/145
6,158,882 A 12/2000 Bischoff, Jr.
6,186,644 B1 * 2/2001 Mosseau ..... A47F 11/10 362/125
6,416,200 B1 7/2002 George
6,450,662 B1 9/2002 Hutchinson
6,566,824 B2 5/2003 Panagotacos et al.
6,652,020 B2 11/2003 Few
6,652,112 B1 * 11/2003 Lucarelli ..... F21V 21/08 362/145
6,686,701 B1 2/2004 Fullarton
6,817,727 B1 11/2004 McFadden
6,854,793 B2 2/2005 Few
7,066,618 B1 6/2006 Little
7,165,863 B1 1/2007 Thomas et al.
D551,591 S 9/2007 Wesorick
D569,544 S 5/2008 Aubrey
D595,887 S 7/2009 Blom
D603,549 S 11/2009 Ng
D623,343 S 9/2010 Klus
D625,463 S 10/2010 Klus
7,815,341 B2 * 10/2010 Steedly ..... F21V 19/0055 362/217.01
D629,554 S 12/2010 Gielen
7,918,591 B2 4/2011 Lynch
8,002,433 B1 * 8/2011 Cucksey ..... F21V 21/30 362/217.01
D647,246 S 10/2011 Chadwick
D655,427 S 3/2012 Sutton
8,167,465 B2 5/2012 Cha
8,240,875 B2 8/2012 Roberts et al.
8,262,264 B2 9/2012 Cooper
8,305,225 B2 * 11/2012 Hefright ..... B60Q 1/2696 340/815.45
D673,779 S 1/2013 Takahashi
D679,860 S 4/2013 Maxik et al.
D696,439 S 12/2013 He et al.
D696,801 S 12/2013 He
8,720,031 B2 5/2014 Sauer
8,926,118 B1 1/2015 Whittaker
9,080,745 B2 7/2015 Quaal et al.
D756,548 S 5/2016 Wang
D764,075 S 8/2016 Honda
D765,882 S 9/2016 Deleu
9,506,609 B1 * 11/2016 Groves ..... H05B 33/086
D775,408 S 12/2016 Huyghe
D780,590 S 3/2017 Komai
D781,644 S 3/2017 Timmermans
D793,617 S 8/2017 Trzcielinski
2003/0218879 A1 11/2003 Tieszen
2004/0196663 A1 10/2004 Ishida et al.
2005/0200495 A1 9/2005 Sibalich
2006/0146531 A1 7/2006 Reo et al.
2006/0146540 A1 7/2006 Reo et al.
2008/0175019 A1 7/2008 Hacker
2009/0237595 A1 9/2009 Kanaya et al.
2009/0267533 A1 10/2009 Lee
2009/0303410 A1 12/2009 Murata et al.
2010/0165607 A1 7/2010 Russo
2010/0315812 A1 12/2010 Liu
2011/0051414 A1 3/2011 Bailey et al.
2012/0212930 A1 8/2012 Kim
2012/0224369 A1 9/2012 Beghelli
2013/0027917 A1 1/2013 Luo
2013/0279156 A1 10/2013 Kaule et al.
2014/0138559 A1 5/2014 Tseng
2014/0203315 A1 7/2014 Kim
2014/0254167 A1 9/2014 Kennedy
2014/0355286 A1 12/2014 Arita
2015/0036355 A1 2/2015 Mitchell
2015/0131287 A1 5/2015 Marsh
2016/0146423 A1 5/2016 Lai
2016/0223166 A1 8/2016 Benson
2017/0040514 A1 2/2017 Yasuhara
2017/0146813 A1 5/2017 Park

* cited by examiner

LIGHT SYSTEM AND METHOD OF INSTALLING

CROSS-REFERENCE TO RELATED APPLICATION

This application is a continuation of U.S. patent application Ser. No. 14/662,991, filed on Mar. 19, 2015, now U.S. Pat. No. 9,506,609, which claims priority to U.S. Provisional Patent Application Ser. No. 61/955,308, filed Mar. 19, 2014, the entirety of each of which is incorporated by reference.

BACKGROUND

Field of the Invention

The present invention relates generally to lighting systems and methods of installing lighting systems and, more specifically, to a lighting system configured fro providing a decorative lighting system for attachment to a building or other.

State of the Related Art

Exterior string lights are attached to the exterior of buildings, such as homes, typically, for a particular holiday or occasion. One occasion where such string lights are attached to the exterior of homes, for example, is Christmas. The lights are often temporarily installed using various clasps, clips or other mechanical fasteners to the eaves, gutters or rooflines of the home prior to the holiday and then removed some time after the holiday.

One attempt in the art to provide a structure for supporting of a string of lights is disclosed in U.S. Pat. No. 6,033,088 to Contigiani. The elongate channel is comprised of two channels that are mated together, with one of the channels having a plurality of evenly spaced holes for receiving the lights from the light string. The other channel is used to mount the elongate housing to an existing structure. U.S. Pat. No. 6,033,088, however, is limited in its ability to be provided in extremely long lengths for providing lights completely or substantially around a building on a single circuit.

Likewise, U.S. Pat. No. 8,926,118 discloses another channel-based system for securing a string of lights relative to the eaves of a building. Specifically, U.S. Pat. No. 8,926,118 is a J-shaped channel for supporting a conventional light string. Like U.S. Pat. No. 6,033,088, U.S. Pat. No. 8,926,118 is necessarily limited to the length of the light strands that can be coupled together on a single circuit and is also limited to provide a single color scheme based on the light strands and bulbs installed in the channel.

It would be advantageous, however, to provide a system for installing a lighting system that not only conceals the string lighting system to a large extent, but that allows the string lighting system to be used for any number of occasions or for providing accent lighting to the house or other building structure and that allows the lighting system to be extended over significant lengths on a single circuit and without requiring multiple light controllers for the light strand.

SUMMARY OF THE INVENTION

Accordingly, the present invention provides an improved lighting system that is configured to be permanently installed on a home or building structure that substantially conceals the lighting system and provides for user controlled adjustment of the color and light patterns of the lights. Moreover, the improved lighting system of the present invention allows a relatively long (e.g., 100 meters), continuous light strand to be installed and controlled by a single controller with the single controller controlling all of the lights in the strand.

These and other aspects of the present invention may be realized in an improved light system as shown and described in the following figures and related description.

BRIEF DESCRIPTION OF THE DRAWINGS

When considered in connection with the following illustrative figures, a more complete understanding of the present invention may be derived by referring to the detailed description. In the figures, like reference numbers refer to like elements or acts throughout the figures. Various embodiments of the present invention are shown and described in reference to the numbered drawings.

Figure 1:
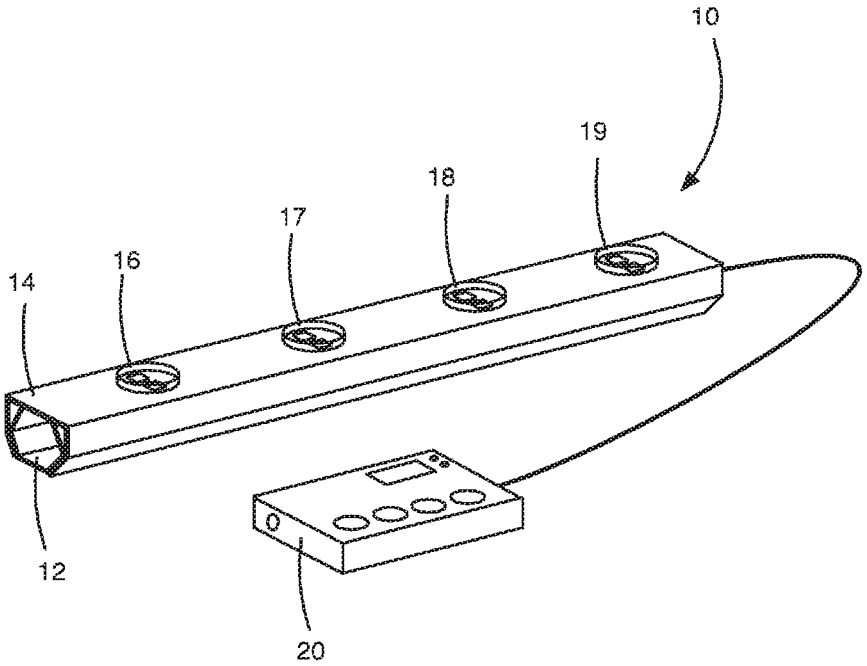
FIG. 1 is a perspective side view of a first embodiment of a lighting system in accordance with the principles of the present invention.

It will be appreciated that the drawings are illustrative and not limiting of the scope of the invention, which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention. Elements and acts in the figures are illustrated for simplicity and have not necessarily been rendered according to any particular sequence or embodiment.

DETAILED DESCRIPTION OF THE ILLUSTRATED EMBODIMENTS

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Detailed Description of the Invention or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. §112, ¶6. Moreover, even if the provisions of 35 U.S.C. §112, ¶6 are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. Thus, the full scope of the inventions is not limited to the examples that are described below.

FIG. 1 illustrates a lighting system, generally indicated at 10, in accordance with the principles of the present invention. The lighting system 10 includes a first elongate channel 12 configured for mounting to a structure, such as a house or other building. A second elongate channel 14 is configured for being removably coupled to the first elongate channel 12. A substantially enclosed elongate space is formed between the first and second elongate channel 12 and 14. A plurality of led lights 16-19, each having a translucent water-tight housing at least one led and a microchip and/or integrated circuit within the translucent housing, coupled to the second elongate channel 14 with each of the translucent water-tight housings of each led 16-19 exposed through a respective holed in the second elongate channel 14. Each LED light 16-19 is connected in series with a plurality of segments of wire, each of the plurality of segments of wire interposed and electrically connected between an adjacent pair of led lights. A microchip and LED light controller 20 is electrically connected to the plurality of segments of wire and sends signals to communicate with each of the plurality of microchips. The controller 20 has a plurality of programmable functions, each function providing at least one of a desired light color for each of the plurality of LED lights 16-19, duration of illumination and timing of illumination.

The present invention also includes a method of installing the lighting system 10, in accordance with the principles of the present invention. The method of installing comprises attaching the first elongate channel 12 to a structure. Securing the second elongate channel 14 to the first elongate channel in a manner that allows for removal of the second channel 14 relative to the first channel 12 in case, for example, one or more of the LED lights needs to be replaced. The microchip and LED light controller 20 is electrically connected to the plurality of segments of wire to communicate with each of the plurality of microchips for controlling the lighting function of each LED light 16-19. It is noted that while the illustration of FIG. 1 shows four LED lights 16-19, each length of channel 14 may be of a length of 8 to 10 feet or more, with LED lights provided at 4, 6 or 8 inch spacing. Thus, FIG. 1 is provided by way of illustration only and not by way of limitation.

Figure 2:
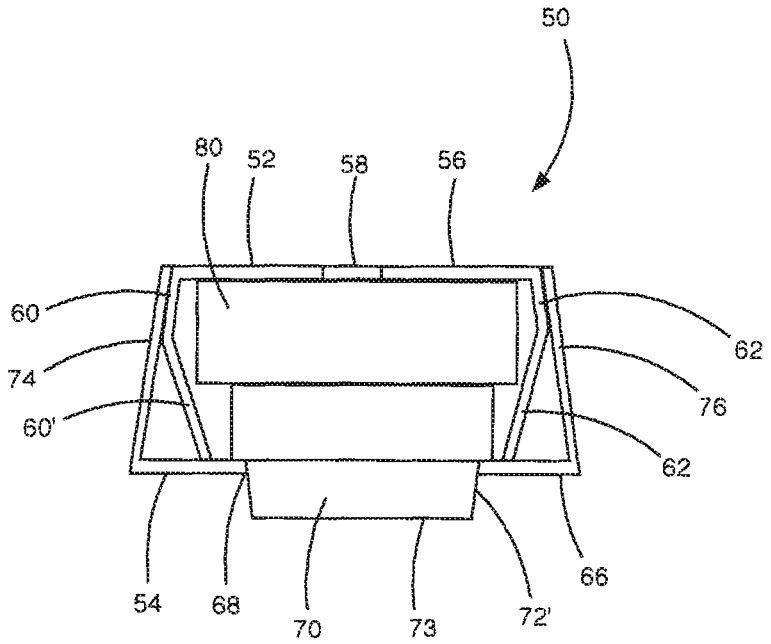
FIG. 2 is an end view of a track and LED light assembly in accordance with the principles of the present invention.

FIG. 2 illustrates a cross-sectional view of an alternative embodiment of a light track, generally indicated at 50 in accordance with the principles of the present invention. The light track 50 is comprised of a first track channel 52 configured for mounting to a structure and a second track channel 54 to which the first track channel 52 is coupled by a biasing force. The first track channel 52 has a base portion 56 configured for attachment to the structure as by attaching the base portion 56 to the structure with a screw or other fastener through hole 58 in the base portion 56. Side walls 60 and 62 extend from the base portion 56. The side walls 60 and 62 have at least a portion 60' and 62' with an inward taper. The second track channel 54 has a base 66 with holes 68 formed therein, each hole 68 configured from receiving at least a portion of the housing 72 there through. The side walls 74 and 76 of the second track channel 54 are inwardly tapered from the base to their distal ends. The first and second track channels are formed from a flexible yet resilient material such as plastic or sheet metal (e.g., aluminum). The spacing between the side walls 60 and 62 at the terminal ends of the side walls 60 and 72 is configured to be less than a spacing between the distal ends of the side walls 74 and 76. As such, once the base 56 of the first track channel 52 is mounted, the second track channel 54 to which the LED lights 70 are attached can be inserted over the first track channel by pressing until the ends of the second track channel 54 bass the bends in the walls 60 and 62 of the first track channel 52. The spacing between the ends of the second track channel 54 is less than the width of the base 56. This causes the side walls 74 and 76 to exert a biasing force against the side walls 60 and 62 when placed there over to hold the second track channel 54 to the first track channel 52 by friction fit. The second track channel 54, however, can be pulled from the first track channel 52 if repair or replacement of any LED light 70 is necessary. The LED light 70 can be held relative to the second track channel 54 by friction fit between the hole 68 and the exposed housing portion 72'. By forming the holed 68 with sharp or serrated edges, the edges of the hole 68 can tightly engage with the exposed housing portion 72'. The exposed housing portion 72' is tapered so as to become wider at its base to be slightly wider than the hole 68 so that a snug friction fit is formed between the housing 72 and the hole 68 of the track channel 54. In instances where the LED light 70 may come into contact with other objects or persons, such as when vertically installing the tracks 52 and 54 along the side of a structure where such contact may dislodge the LED housing 72 from the hole 68, a strip of resilient backing material 80 may be interposed between the back of the LED light 70 and the base 56 so as to provide a biasing force to the base of the LED light 70 and thus hold it within the hole 68 as illustrated. The resilient backing material 80 may be comprised of a strip of closed cell foam that is impermeable to water to allow any water than may enter the space to flow out without being retained by the backing material.

Figure 3A:
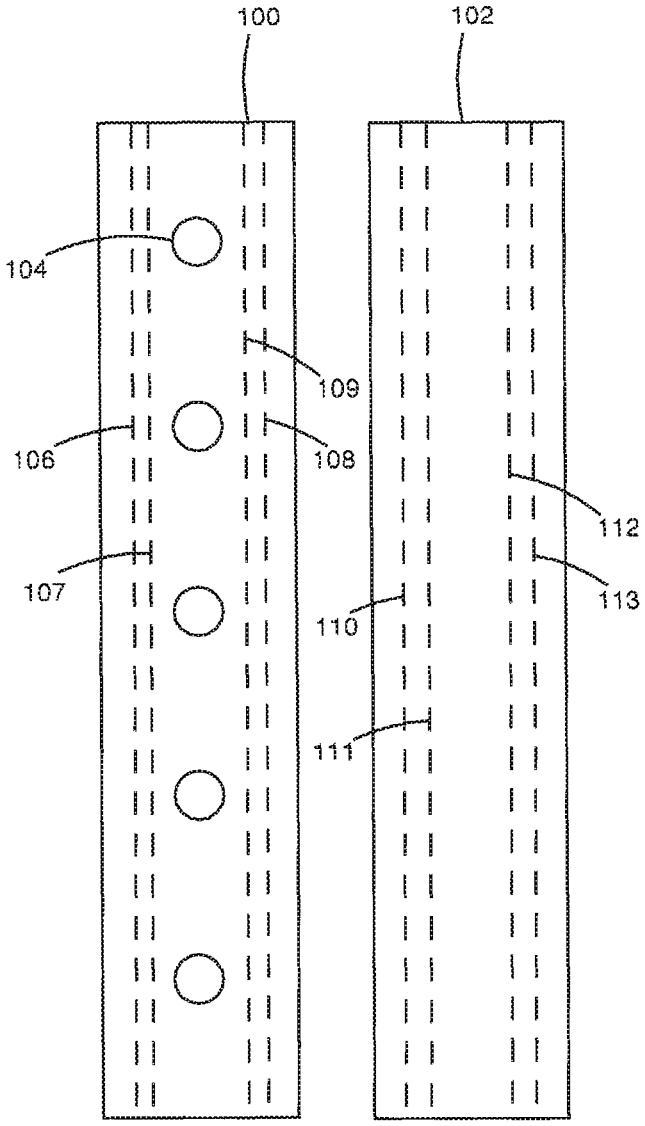
FIG. 3A is a plan view of two strips of metal for forming two interlocking channels of a track assembly for a lighting system in accordance with the principles of the present invention.
Figure 3B:
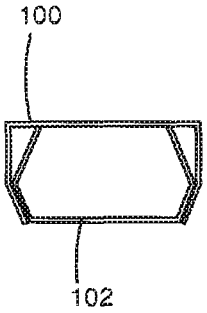
FIG. 3B is an end view of two interlocking channels of a track assembly formed by folding the two strips of metal shown in FIG. 3A in accordance with the principles of the present invention.

As shown in FIG. 3A and FIG. 3B, elongate track channels may be formed from elongate strips of metal 100 and 102, such as aluminum sheets. The strips 100 and 102 may be cut from wider sheets of metal as the case may be. The strip 100 to which the LED lights are attached includes a plurality of evenly spaced holes 104 that are cut through the strip 100 as by laser cutting, drilling, punching or other methods known in the art. Once the holes 104 are formed, the sheet 100 is bent along its length along the bend lines 106-109 into the shape shown in FIG. 3B. Similarly, the strip 102 is bent along bend lines 110-113 into the shape also shown in FIG. 3B. While the shape of the channels 100 and 102 have a different shape than the channels 52 and 54 of FIG. 2, the same biasing principles apply to maintain the first and second channels together when one is inserted into the other. It should be noted that while the channel through which the lights are exposed is inserted over the base channel to position any exposed edges of the outer channel at or near the base of the base channel, the two channels could be reversed so that the channel 100 is inserted into the channel 102.

Figure 4:
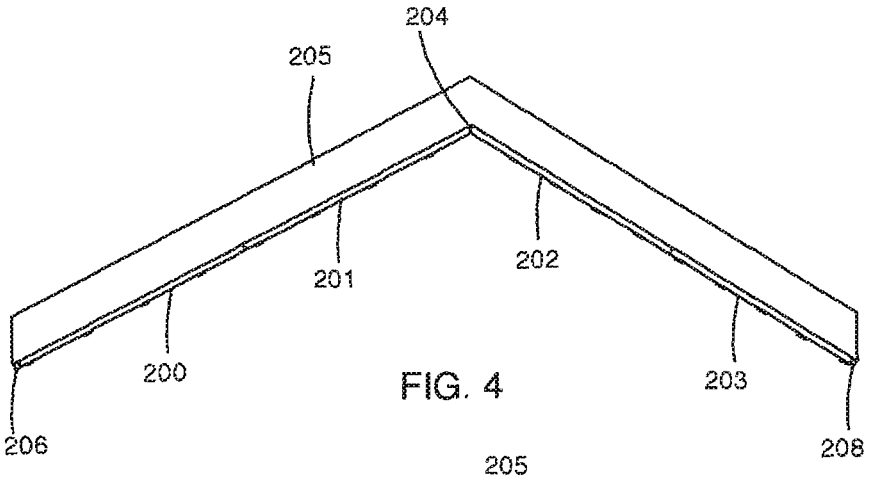
FIG. 4 is a side view of a lighting system in accordance with the principles of the present invention installed under an eave of a building.

As illustrated in FIG. 4, a plurality of lighting tracks 200-203 are attached to the underside of an eve 205 of a building structure, such as a house. Each pair of adjacent tracks is abutted at their ends so as to provide the appearance of a continuous track. In addition, the spacing between the last light of a track is half of the spacing between lights of the track so that when two tracks 200 and 201 are abutted, the spacing between lights remains consistent. Also, when angles of the structure are in the bath of the tracks 201 and 202, a bevel and/or miter cut 204 may be made to the ends of the abutting channels 201 and 202 so that the tracks fit relatively tightly together. The terminal ends of any tracks 200 and 203 can be provided with end caps 206 and 208/, such as end caps from plastic that attaché by friction fit into the ends of the tracks 200 and 201.

Figure 5A:
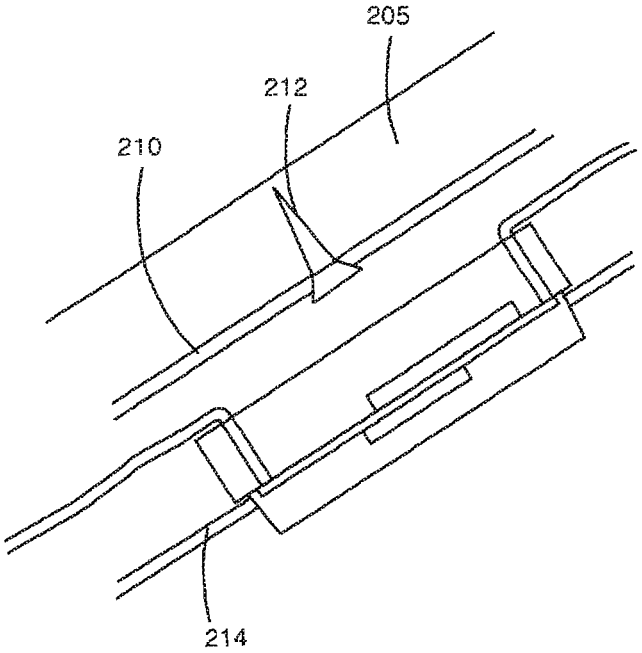
FIG. 5A is a close-up, partial cross-sectional side view of the lighting system in accordance with the principles of the present invention installed under the eave of the building shown in FIG. 4.

As illustrated in FIG. 5A, the base track 210 is attached to the eve 205 with a plurality of fasteners 212 to secure the base track 210 to the underside of the eve 205. The light housing track 214 is then pressed onto the base track 210 to attach the light housing track 214 to the base track 210. This configuration and method of mounting provides a very fast and efficient means for mounting a lighting system to a structure. In addition, as shown in FIG. 4, the lighting system is relatively discrete with the lighting system being relatively concealed. This is further achieved by forming at least the outer or exposed track 214 from a material having the same or similar color as the surface of the structure to which the lighting system is attached. By forming the tracks 210 and 214 from the same materials and of the same color as those often found on soffits, fascia and gutters, the tracks will blend into the look of the structure. As such, a user can have the lighting system permanently installed on the structure that can be used for various occasions, including holidays, birthdays and other events.

Figure 5B:
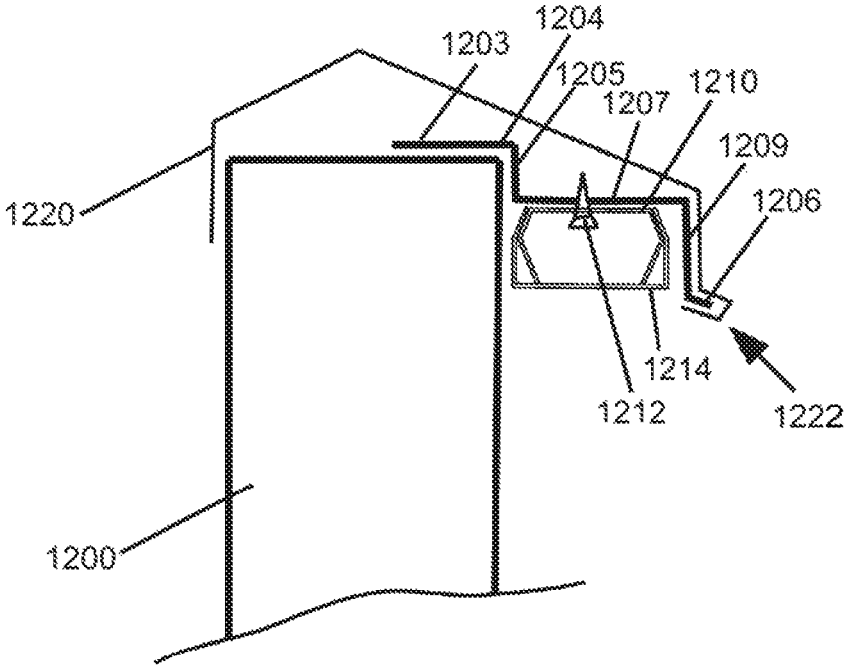
FIG. 5B is a cross-sectional end view of a lighting system including two interlocking channels of installed on a parapet wall using a parapet wall installation clip.

FIG. 5B depicts a cross-sectional end view of a lighting system including two interlocking channels 1210 and 1214 installed on a parapet wall 1200 using a parapet wall installation clip 1204.

A parapet wall clip 1204 or bracket may be constructed as a "stepped" member having a wall connection section 1203 which is a generally planar portion beginning at a first end and extending to a second end for installation on the top surface of a parapet wall 1200, using suitable fasteners and/or adhesives (not depicted). At the second end, or wall connection section 1203, a first perpendicular section 1205 formed as a generally planar portion which may be generally perpendicular to wall connection section is disposed, and extends down a desired length to a channel connection section 1207 formed as a generally planar portion parallel to the wall connection section 1203. A second perpendicular section 1209 formed as a generally planar portion which may be generally perpendicular to channel connection section 1207 is disposed at the other end and extends downwards to an angled tail 1206. Upon installation, parapet wall clip may reside under a parapet wall cap 1220 with the angled tail 1206 residing in a channel (generally indicated at 1222) for increased stability.

The base track 1210 is attached to the parapet wall clip 1204 with a plurality of fasteners 1212 to secure the base track 1210 to the underside channel connection section 1207 of the parapet wall clip 1204. The light housing track 1214 is then pressed onto the base track 1210 to attach the light housing track 1214 to the base track 1210. This configuration and method of mounting provides a very fast and efficient means for mounting a lighting system to a structure. In addition, as shown in FIG. 5B, the lighting system is relatively discrete with the lighting system being relatively concealed. This may be further achieved by forming at least the outer or exposed track 1214 from a material having the same or similar color as the parapet wall cap 1220, such that the tracks will blend into the look of the structure.

Figure 6A:
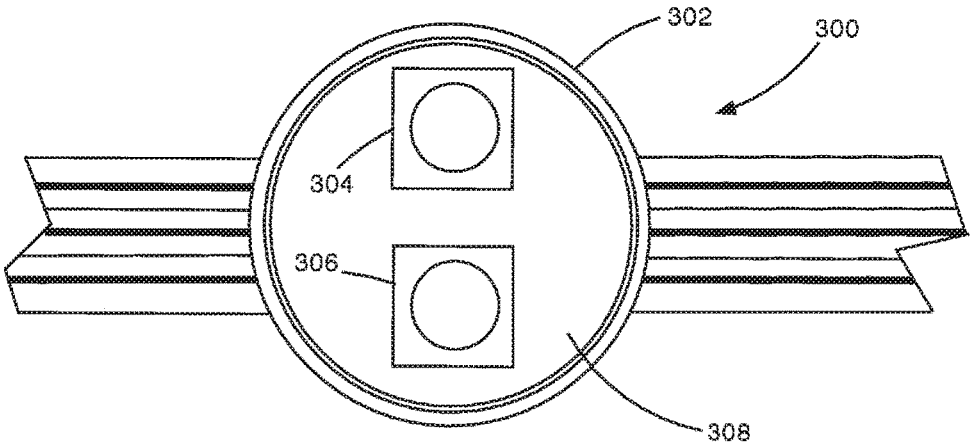
FIG. 6A is a top side view of a first embodiment of an LED light assembly in accordance with the principles of the present invention.
Figure 6B:
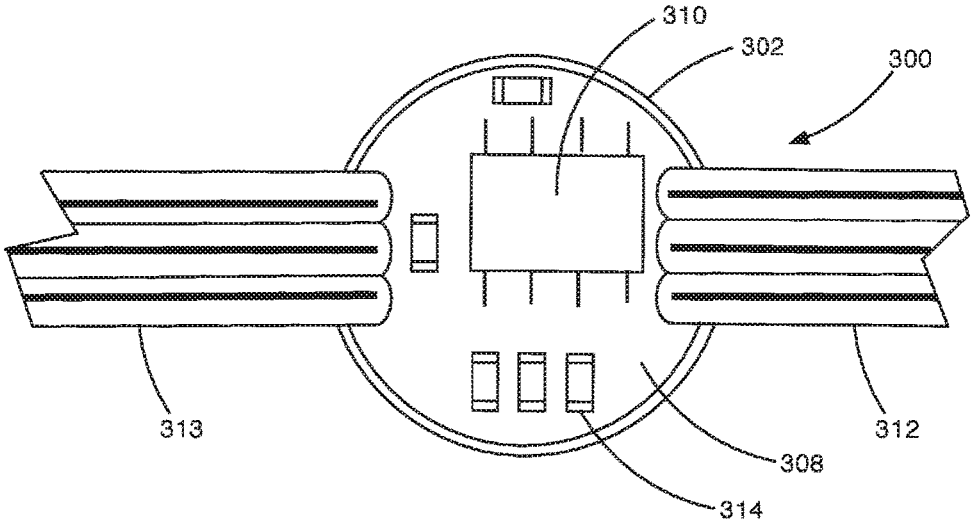
FIG. 6B is a back side view of the LED light assembly shown in FIG. 6A.
Figure 6C:
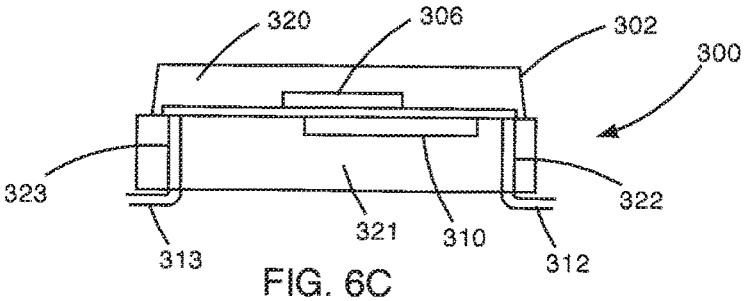
FIG. 6C is a partial cross-sectional side view of the LED light assembly shown in FIGS. 6A and 6B.

FIGS. 6A, 6B and 6C show top, bottom and side views of an LED light, generally indicated at 300, in according to the principles of the present invention. The LED light 300 comprises a clear plastic housing 302 that encapsulates the LED lights 304 and 306 and corresponding electronics. The housing 320 may be formed by a molding process in which the plastic material is poured over the electronics during a forming process to form a completely watertight layer over all of the electronics. Thus, the housing 302 provides a water-tight seal around the electronics and LED lights 304 and 306 so as to prevent water damage to the electronics that may occur when the lighting system of the present invention is installed in its intended location on the exterior of a building structure. By providing two multi-color bright LEDs 304 and 306, the LED light 300 can reproduce a multitude of colors. The LEDs 304 and 306 are attached to a circuit board 308. On the underside of the circuit board 308 a microchip 310 is coupled between the wiring 312 and the LEDs 304 and 306. Signals from the controller (see FIG. 1) are received through the wiring 312 by the microchip 310. The microchip then controls the two LEDs 304 and 306 as to color, illumination, brightness, illumination sequence and illumination duration. Other electronic components, such as resistors 314, are provided to provide the proper voltage and current to the microchip 310 and LEDs 304 and 306. Signals for other LED lights are also passed through the circuit board 308 to other LED lights in the series through wires 313, with each LED light in the series being individually controlled by the controller and their corresponding microchips. Each interconnecting wire 312 and 312 is formed from three wires for providing power to the LEDs 304 and 306 and signals to the microchips.

As illustrated in FIG. 6C, the LEDs 304 and 306 (only LED 306 being visible), are positioned within the upper clear lens portion 320 of the housing 320 so that light from the LEDs 304 and 306 will shine through the lens 320. The microchip 310 and ends 322 and 323 of the wires 312 and 313, respectively, are encapsulated in the base portion 321 of the housing 302 to provide a waterproof seal around the wires 312 and 313 and the electronic components of the LED 300.

The controller has a broad working temperature to be able to handle all weather conditions from −20 to 60 degrees C. Importantly, it also operates at 12 volt DC power supply with a 60 mA current so that the lights operate on this low voltage power in order to minimize risks from a fire hazard. The controller is relatively small having a length of about 130 mm, width of 25 mm and weight of 280 g. The controller can control, for example, 1024 individual lights at low speed or 2048 at high speed. The distance of the first light to controller at low speed is 40 m and at high speed is 20 m allowing for the controller to be placed in an inside location with the lights in an outside location.

Figure 7:
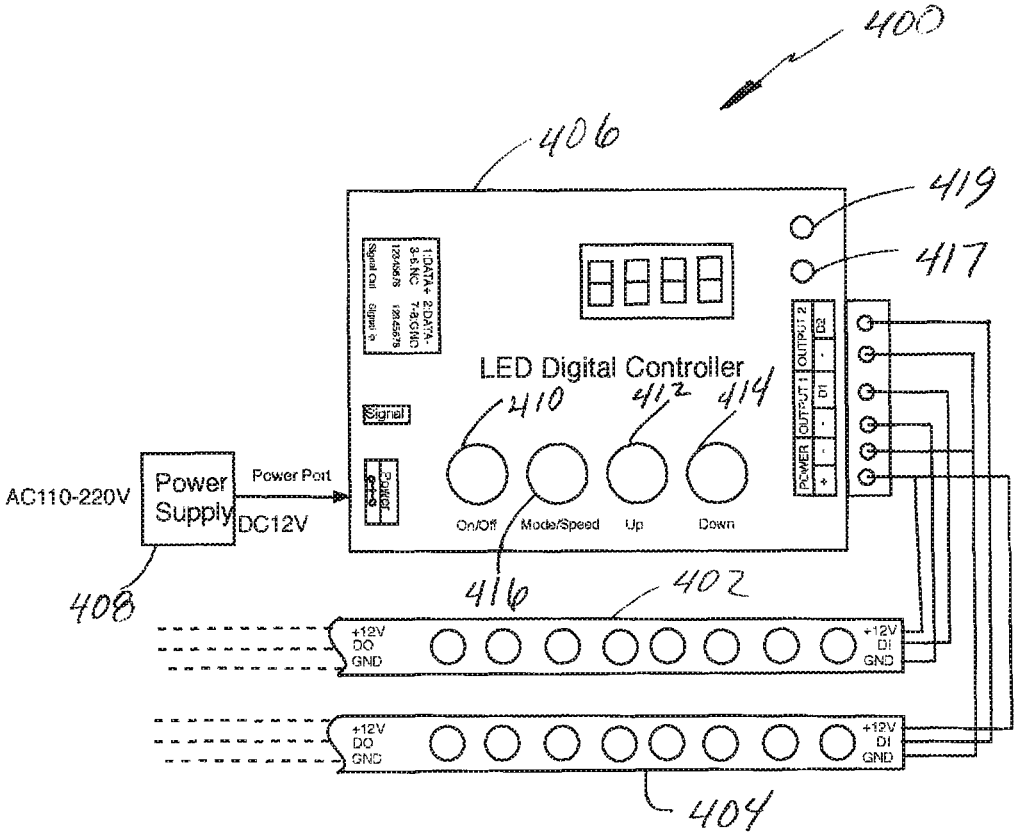
FIG. 7 is a controller and light assembly wiring diagram in accordance with the principles of the present invention.

FIG. 7 illustrates a connection diagram for a lighting system 400 of the present invention. The lighting system 400 includes light strips 402 and 404 that are powered and controlled by the controller 406. The controller 406 is connected to a power supply 408 for providing DC current to the controller. The controller sends digital signals D1 and D2 to the respective light strips 402 and 404 based on the light program selected by the user. The controller 406 is able to simultaneously control two light strips 402 and 404 as shown or a single strand 402.

Figure 8:
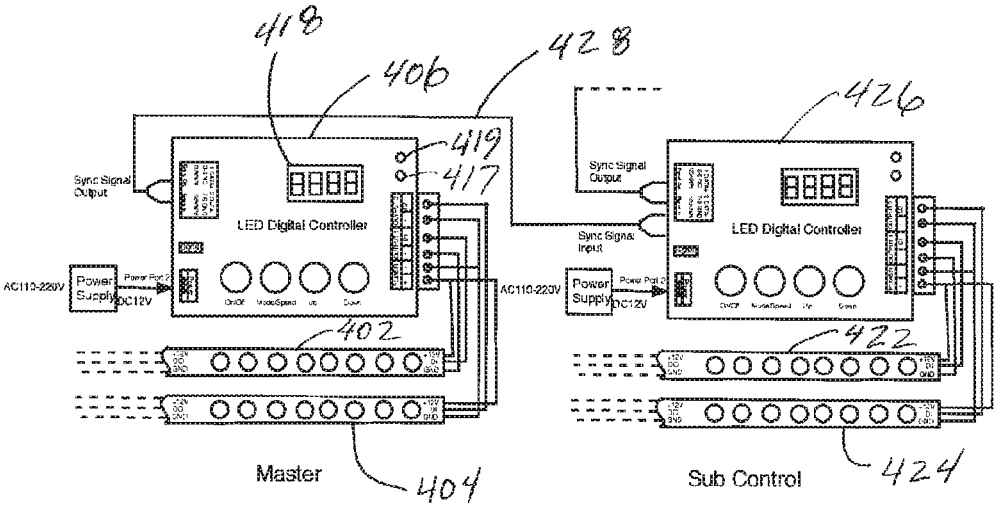
FIG. 8 is a wiring diagram for a dual synchronized controller arrangement and corresponding light assemblies in accordance with the principles of the present invention.

A single controller can be used or, as shown in FIG. 8, linked with another controller 426 to power other light strips 422 and 424. The two controllers 406 and 426 are linked together with a cable 428 so that the two controllers 406 and 426 are synched such that the light strips 402, 404, 422 and 424 work in a synchronous manner. A synchronous control system can be made of any number of controllers connected in series. Each of the sub-controllers is programmed to follow the first master controller to achieve a permanent synchronous change without delay. After connecting the controllers 406 and 426 as illustrated in the wiring diagram, the sub-controllers do not need to be individually set. They are controlled in accordance with the master controller 406 to control the speed and mode change. When the master controller 406 is in operation and controlling the sub-controllers 426, the green light 419 may flash and digital LED display 418 will display the mode of operation.

Referring again to FIG. 7, once the controller 406 is connected to the lights, the "On/Off" button 410 can be pressed to turn on the controller 406. Pressing the up or down buttons 412 and 414 changes the brightness of the LEDs. Pressing "Mode/Speed" button 416 allows the user to change the "High-speed, low-speed settings", where the LED will display "S-HI" or "S-LO". Pressing the "up" and "down" buttons 412 and 414 is used to select the mode. If the IC on the lights is in high-speed mode, the user chooses "S-HI", and chooses "S-LO" when in a low-speed mode.

Continuing to press the "Mode/Speed" button 416 enters the "Control points setting". The LED display's 418 4-digits are for the number of control points. The user can change the numbers by pressing the "up" or "down" buttons 412 and 414. Pressing the "On/Off" button 410 will save the settings and exit.

When the controller 406 is turned on, the user can press the "up" or "down" buttons 412 and 414 to change the mode and speed.

The red and green lights 417 and 419 on the controller provide a power indication and whether the controller is recognizing a user input, where the red light 417 indicates power and the green light 419 flashes upon each press of a button.

The user can also edit the various scenes into a particularly desired patter. In the edit mode, the user can edit scenes from, for example, 2 to 20 (1 to 132 mode) into a circular pattern. Each pattern can be set individually for each change of speed. In addition, the controller can automatically identify the set of patterns and automatically loop the pattern.

Pressing the "Mode/Speed" and "Up" buttons at the same time enters an edit menu and the screen indicates the scene number of current editor. The user can then select the number to edit a scene by the "+" or "−" keys.

After selecting the scene to edit, pressing the "Mode/Speed" key displays the setting current scene mode. Pressing the "+" or "−" key chooses the scene mode.

After choosing a mode, when the user presses the "Mode/Speed" key the speed of the current scene mode can be set. The speed of the scene is changed by pressing the "+" or "−" keys.

After choosing the speed, pressing the "Mode/Speed" key returns the controller to the selection screen. The user can then select the next scene to edit by pressing the "+" or "−" key, or exit and save the setting by pressing the "On/Off" key.

When programmed, the controller can be used to select various lighting schemes. Table I below provides a menu list of various programs.

TABLE I

| Program No. | Function Description | Program No. | Function Description |
|---|---|---|---|
| 1 | Static blue | 2 | Static green |
| 3 | Static red | 4 | Static cyan |
| 5 | Static yellow | 6 | Static purple |
| 7 | Static white | 8 | Three color jumpy change |
| 9 | Seven color jumpy change | 10 | Seven color strobe flash |
| 11 | Red horse race lamp to right direction | 12 | Purple horse race lamp to left direction |
| 13 | Blue horse race lamp to right direction | 14 | Cyan horse race lamp to left direction |
| 15 | Seven color cycling horse race lamp to right direction | 16 | Seven color cycling horse race lamp to left direction |
| 17 | Seven color horse race lamp back-for-ward direction | 18 | Seven color horse race lamp to left direction |
| 19 | Seven color jumping horse race lamp to right direction | 20 | Three color gradually change |
| 21 | Seven color gradually change | 22 | Red background scan lamp back-for-ward direction |
| 23 | Green background scan lamp back-for-ward direction | 24 | Blue background scan lamp back-for-ward direction |
| 25 | Yellow background scan lamp back-for-ward direction | 26 | Cyan background scan lamp back-for-ward direction |
| 27 | Purple background scan lamp back-for-ward direction | 28 | White background scan lamp back-for-ward direction |
| 29 | Seven color scan lamp back-for-ward direction | 30 | Red water move to right direction |
| 31 | Redwater move to left direction | 32 | Green water move to right direction |
| 33 | Green water move to left direction | 34 | Blue water move to right direction |
| 35 | Blue water move to left direction | 36 | Yellow water move to right direction |
| 37 | Yellow water move to left direction | 38 | Cyan water move to right direction |
| 39 | Cyan water move to left direction | 40 | Purple water move to right direction |

TABLE I-continued

| Program No. | Function Description | Program No. | Function Description |
|---|---|---|---|
| 41 | Purple water move to left direction | 42 | White water move to right direction |
| 43 | White water move to left direction | 44 | Seven color cycling water move to right direction |
| 45 | Seven colo rbreathing lamp back-for-ward direction | 46 | Red trail to left single direction |
| 47 | Purple trail to left single direction | 48 | Blue trail to left single direction |
| 49 | Cyan trail to left single direction | 50 | White trail to left single direction |

When a particular program is selected, the LEDs of the lighting system will perform the selected program until the program is changed or the system is turned off. It should be noted that the programs of Table I are for illustration purposes only and not to be interpreted as limiting in any manner.

Figure 9:
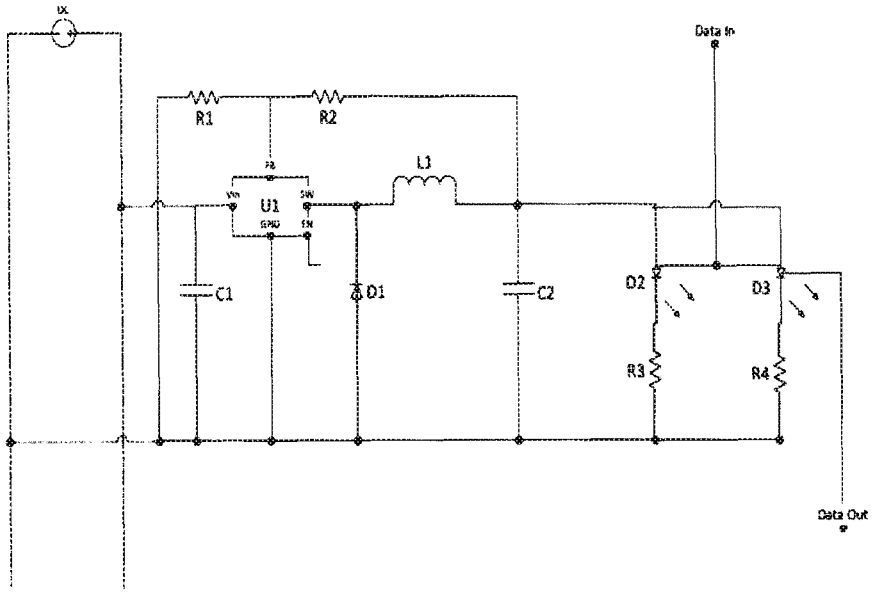
FIG. 9 is a circuit diagram of an LED light assembly in accordance with the principles of the present invention.

The lighting system of the present invention is configured to extend for long distances (e.g., approximately 100 meters or more) using a single lighting controller and voltage source. That is, unlike the 12 volt systems of FIGS. 7 and 8, which may require multiple controllers depending on the length of lights to be installed, the present invention can extend for significant distances with a single controller supplying a voltage. Typically, the forward voltage of an LED is about 1.8-3.3 volts and varies by the color of the LED. A red LED typically drops 1.8 volts, but voltage drop normally rises as the light frequency increases, so a blue LED may drop around 3.3 volts. Thus, for a 12 volt, 36 volt or 48 volt system according to the present invention, a conventional LED system would not allow long lengths of the very bright dual LED lights of the light string of the present invention. In order to handle the voltage drop that is typically associated with LED lights, each LED light includes the components of the circuit diagram shown in FIG. 9.

The circuit includes two programmable RGB LEDs D2 and D3 in parallel. A voltage regulator U1 limits the voltage drop normally associated with the LEDs. The Data In is received by the programmable RGB LEDs D2 and D3 controls the function of the LEDs D2 and D3. The Data Out is sent to the next light in the string of LEDs. The DC voltage coming into the system is routed through the voltage regulator U1 and into an inductor L1. Two electrolytic capacitors C1 and C2 are in parallel and resisters R1 and R2 are in series. A diode D1 is placed between the microprocessor U1 and the inductor L1. Voltage passing through the LEDs, pass through respective resistors R3 and R4 in parallel. The combination of resistors, capacitors inductors and diodes allows reduces the voltage drop normally associated with LEDs and allows hundreds of the dual LED lights to be used in a single strand that can extend at least 100 meters. The following is a table of the electrical components used in the circuit.

| Identifier(s | Manufacturer | Part # | Description |
|---|---|---|---|
| U1 | XLSEMI | XL7005 | Voltage Regulator |
| L1 | Taiyo Yuden | *NR6028T470M | 47 uH SMD Inductor |
| C1 | Lelon | *REA330M1HBK- | 33 uF Electrolytic Capacitor |
| C2 | Lelon | *RGA101M1VBK- | 100 uF Electrolytic Capacitor |
| D1 | Fairchild | *S210 | 2A 100 V Schottky Diode |
| D2, D3 | WorldSemi Co, | WS2812B | Programmable RGB LED |

-continued

| Identifier(s | Manufacturer | Part # | Description |
|---|---|---|---|
| R1 | Vishay | *CRCW08053K30F | ⅛ W 3.3 kOhm SMD |
| R2 | Vishay | *CRCW080510K0F | ⅛ W 10 kOhm SMD |
| R3, R4 | Panasonic | *ERJ--□P06D90R9V | ½ W 90.9 Ohm SMD |

The WS2812 is an RGB LED with a WS2811 control IC built into the LED. A WS2811 control IC is 3 output channel IC for LED driver circuits. Thus, the data in can be received directly by the LED in order to control the function of the LED. The XL7005 voltage regulator is a 180 KHz fixed frequency PWM buck (step-down) DC/DC converter, capable of driving a 0.5 A load with high efficiency, low ripple and excellent line and load regulation. The voltage regulator includes internal frequency compensation and a fixed-frequency oscillator. The voltage regulator U1 passes enough voltage through the RGB LEDs to provide proper illumination while allowing other current not necessary for the LEDs to bypass the LEDs and thus be send to the next LED light. As such, rather than passing all current through the LEDs, only the amount of current required for each set of LEDs D2 and D3 is utilized in the circuit, allowing a higher efficient use of current through each light in the string of lights. Of course other comparable electrical components may be used.

Figure 10:
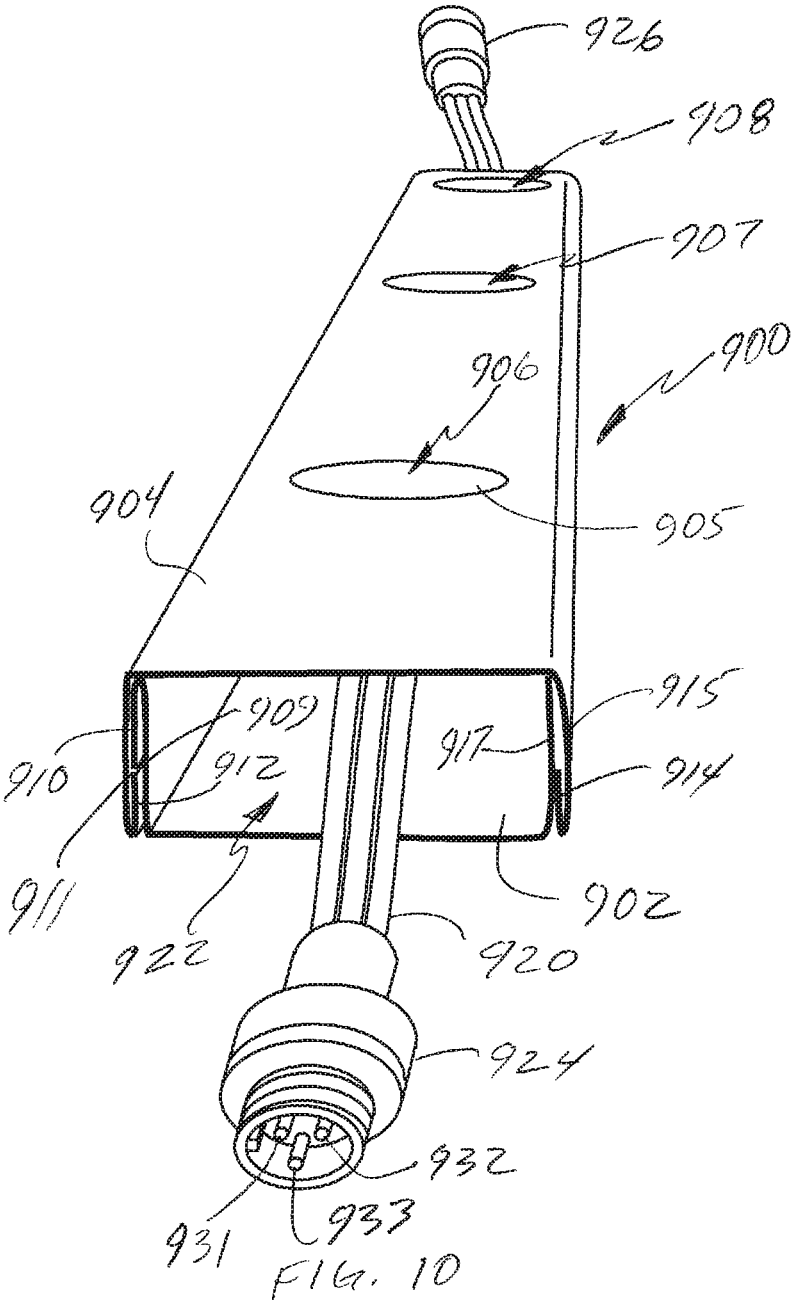
FIG. 10 is a perspective end view of an alternative embodiment of a section of a lighting system in accordance with the principles of the present invention.

FIG. 10 illustrates an alternative embodiment of a light track, generally indicated at 900 in accordance with the principles of the present invention. The light track 900 is comprised of two interlocking channels 902 and 904. The channel 904 includes a plurality of evenly spaced holed, each sized to receive a lens 905 of an LED light assembly 906. Both channels 902 and 904 are generally rectangular in shape. The outer channel 904 has inwardly folded edges that extend about half the height of the channel 904. The inner channel 902 includes an externally folded portion 910 that extends on the outside of the track 902 about half the height of the track 902. The edge of the folded portion 910 engages with an inwardly folded portion 912 of the channel 904 when the two channels 902 and 904 are fitted together. Thus, the longitudinal edge 909 of the channel 904 fits over the longitudinal edge 911 of the channel 904 to provide a snap fit between the two channels 902 and 904, thus interlocking the two channels. The inwardly folded portion 914 of the side wall 915 of channel 904 abuts against the outside surface of side wall 917 of the channel 902 to form a friction fit therein between and to provide an inwardly applied bias by the folded portion 914 to the side wall 917 to secure the two channels 902 and 904 together, but to allow the two channels 902 and 904 to be separated or released in the event that the light string 920 requires repair. The light string 920 fits within the passage 922 provided by the two channels 902 and 904 when mated together.

The light string 920, while shown as having three LED light assemblies 906, 907 and 908, may have about 50 such light assemblies per strand. A strand is defined as a length of lights having connection ends 924 and 926, with end 924 comprising a female end with three pins, one pin 931 for voltage, one pin 932 for ground and one pin 933 for the digital light control signal, configured to mate with a female end 926 of another strand by threading the two ends 924 and 924 together. The ends 924 and 926, when properly mated, provide a weather tight seal so as to be waterproof in the event that water enters the passage 922. Each strand may be between about 35 feet to 40 feet in length, with a light assembly every 6 to 10 inches. Ideally, the light strand is about 37 feet in length with a light assembly every 9 inches. The LED lights are configured to operate on a voltage that is less than the voltage provided by the controller. For example, the LED assemblies 906-908 are configured to operate on at least 36 volts, but can also operate on higher voltages up to 48 volts to allow for longer strands of lights to be coupled to and operated by a single controller. As previously discussed, the voltage regulator provides the proper voltage to the lights while allowing unused current to pass down the string of lights to help power LED light assemblies at the end of the string. For such a system of 37 feet light strands, each having 50 lights per strand spaced 9 inches apart, the controller of the present invention can provide sufficient current to all LED light assemblies for about 9 strands wired in series. That equates to 333 feet and 450 light assemblies spaced 9 inches apart. Of course, those of skill in the art will understand from the invention disclosed herein that other light spacing and numbers of light assemblies can be used in accordance with the principles of the present invention.

Figure 11:
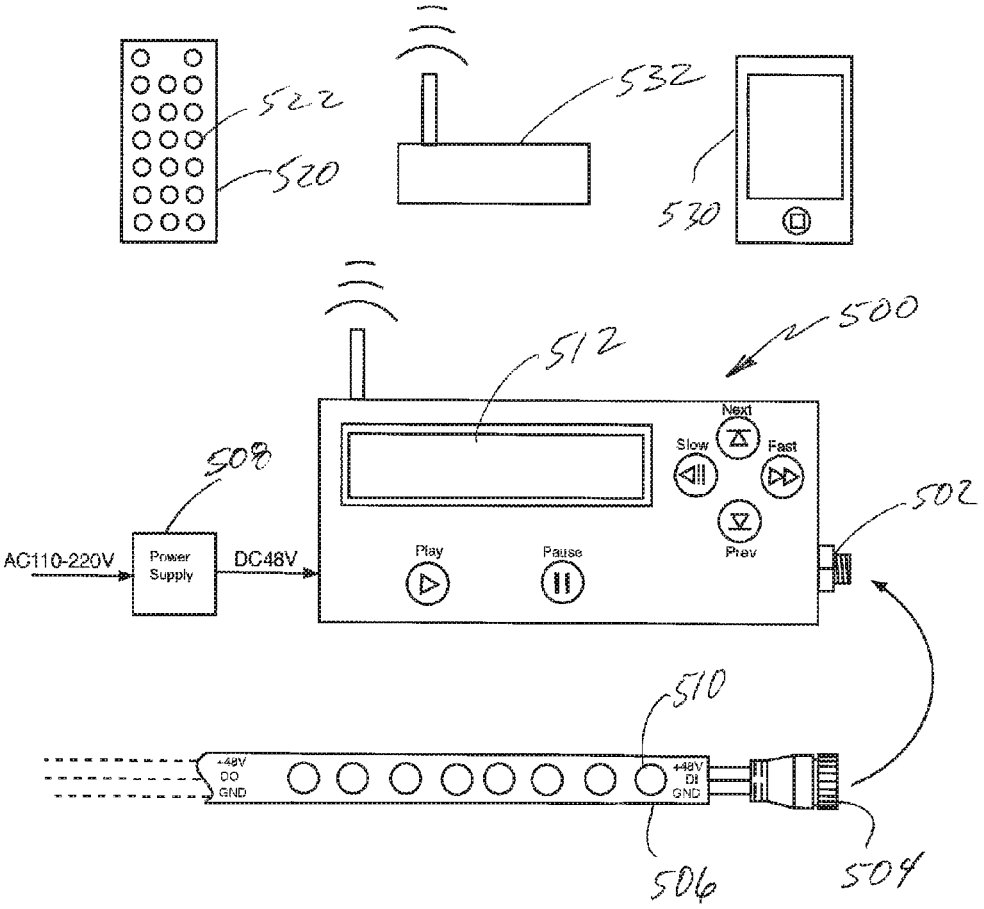
FIG. 11 is an alternative embodiment of a controller and light assembly wiring diagram in accordance with the principles of the present invention.
Figures 12A, 12B, 12C, 12D:
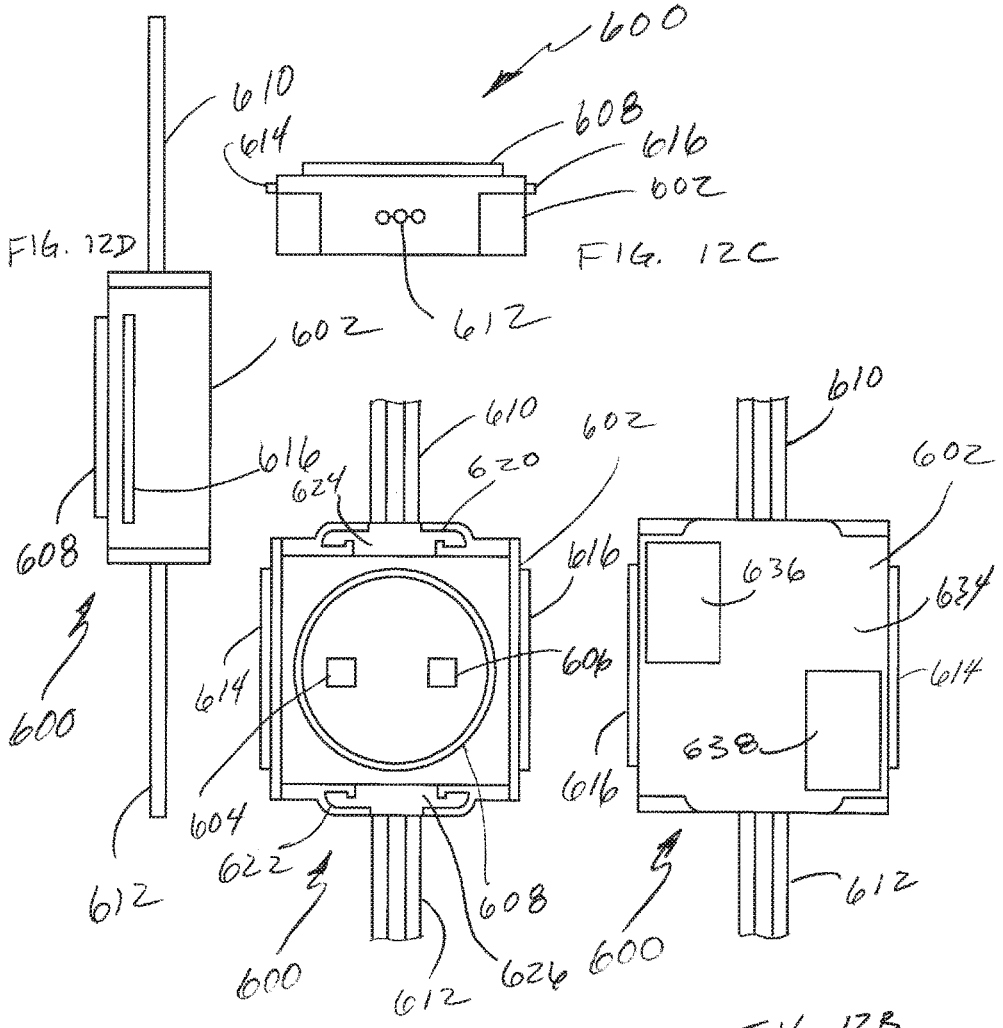
FIGS. 12A-12D are front, back, end and side view, respectively, of an alternative embodiment of a LED light assembly according to the principles of the present invention.

As shown in FIG. 11, a controller 500 in accordance with the principles of the present invention, is connected with a threaded male/female connection 502 and 504 between the controller 500 and the light track assembly 506 according to the present invention. The controller 500 is driven by a power supply 508 connected to AC current, whether 110V or 220V. The controller 500 includes executable instructions in firmware or software that deliver a digital signal to the light track assembly 506 to individually control each individual light, such as light 510. The controller 500 includes an LCD screen 512 for viewing each change of function or operating mode of the controller 500 by the user. In addition, various input buttons are provided to start a particular light sequence by pressing the Play button, pausing the light sequence by pressing the Pause button, slowing the light sequence by pressing the Slow button, or increasing the speed of the light sequence by pressing the Fast button. The Next and Previous buttons are used for controlling the menu system programmed into the controller 500 that appears in the LCD screen 512, as well as other functions for selecting a particular light pattern and/or color scheme for the light track assembly 506.

In addition to the input buttons on the face of the controller 500, a handheld wireless remote 520 may be configured to connect with the controller 500 to operate all functions of the controller 500 using the keys 522 on the remote 520. The wireless remote may connect to the controller 500 using infrared or RF wireless transmission protocols and systems known in the art. Likewise, the controller 500 may include other wireless communication hardware and firmware to allow the controller 500 to receive control signals from a wireless device such as a smartphone 530, smart tablet, computer or other computer based system having a processor, executable instructions (such as a smartphone app) and wireless communication capabilities. For such wireless communications, the wireless device 530 may communication with the controller 500 using a wireless network and communication through a wireless router 532 such that the wireless device 530 sends and receives signals from the controller 500 through the wireless network router 532, such as a Wi-Fi router. Likewise, the wireless device 530 may communicate directly with the controller 500 if the wireless controller includes wireless communication hardware, such as a Wi-Fi or Bluetooth chip configured for direct communication with a handheld or other wireless device.

A light assembly 600 according to the present invention, as shown in FIGS. 12A-12D is comprised of a rectangular housing 602 within which the RGB LEDs 604 and 606 with built-in ICs (not shown) are encased in a clear lens cover 608. The longitudinal sides of the housing in line with the wires 610 and 612 extending from the housing 602 include elongate protrusions 614 and 616. In addition, the housing 602 includes T-shaped channels 620 and 622 that extend from the top of the housing toward the bottom for receiving wire support members 624 and 626 that are molded to the ends of the wires 610 and 612 entering the housing 602 to provide a water proof seal between the wires 610 and 612 and the housing 602 and to prevent kinking and subsequent shorts in the wires 610 and 612. The wire support members 624 and 626 may be formed from rubber or other flexible materials known in the art that can be molded to and or fitted to the housing 602 in a watertight manner. The back side 634 of the housing 602 is provided with rectangular recesses 636 and 638.

Figure 13A:
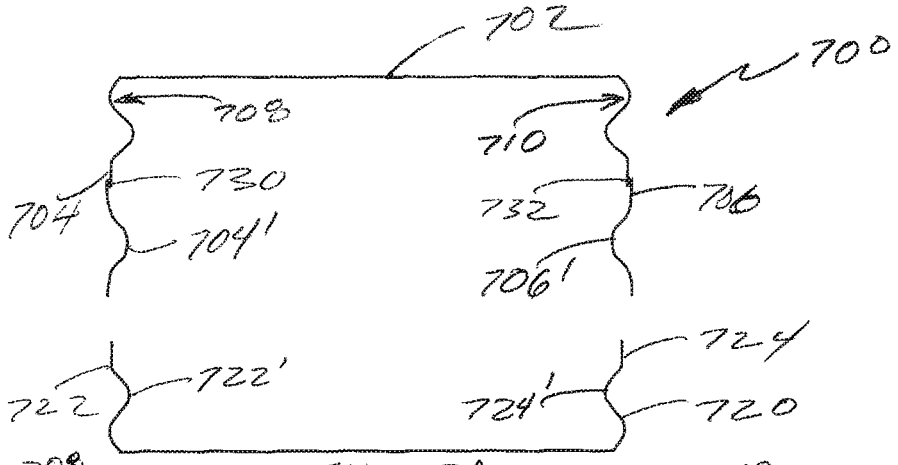
FIGS. 13A and 13B are end views of an alternative embodiment of first and second channels forming a light track assembly in accordance with the principles of the present invention.
Figure 13B:
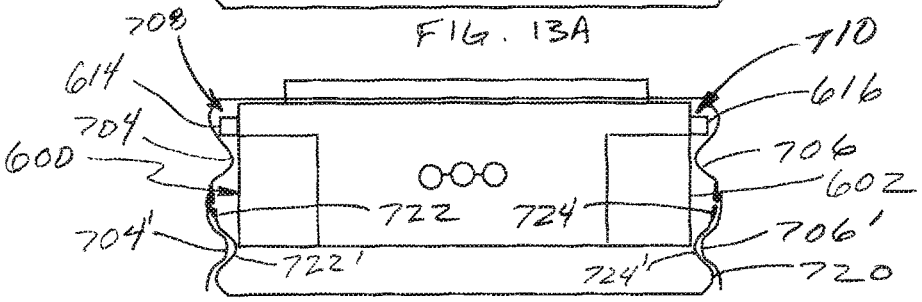

As shown in FIGS. 13A, 13B, 14A and 14B, the elongate protrusions 614 and 616 of the housing 602 of LED light assembly 600 mates with a first channel 702 of the channel system 700 (FIGS. 13A and 13B) or a first channel 802 of the channel system 800 (FIGS. 14A and 14B) according to the present invention. Referring to FIGS. 13A and 13B, the first channel 702 has corrugated sides 704 and 706 defining upper recesses 708 and 710 configured to receive and retain in a snap-fit manner the protrusions 614 and 616. Thus, the light assembly 600 can be snapped into the first channel 702 prior to installation to hold the light assemblies 600 in place while the first track 702 is being coupled to the second track 720. The second track 720 also has corrugated sides 722 and 724 configured to fit within the sides 704 and 706 of the first channel 702 with the recesses 722' and 724' engaging the corresponding inward protrusions 704' and 706' of the first channel 702 as shown in FIG. 13B. The sides 704 and 706 are provided with overlapping bends 730 an d732 that provide an abutment so that the top edges of side walls 722 and 724 abut against the fold created by the bends 730 and 734.

Figure 14A:
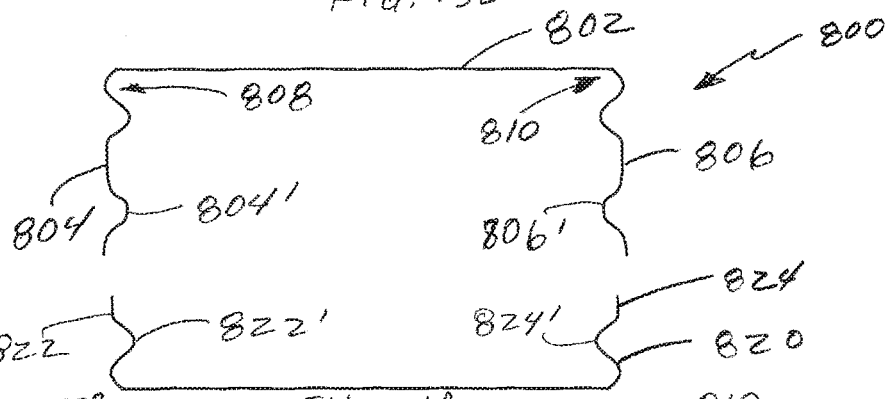
FIGS. 14A and 14B are end views of yet another alternative embodiment of first and second channels forming a light track assembly in accordance with the principles of the present invention.
Figure 14B:
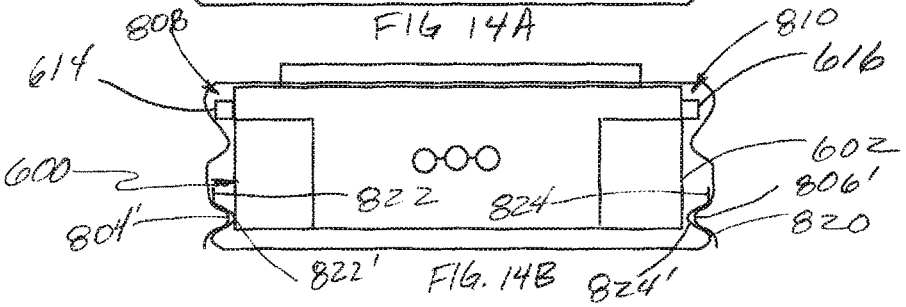

The channels 802 and 804 of the channel assembly 800 shown in FIGS. 14A and 14B are configures similarly to the channel assembly 700 without the overlapping bends in the side walls 804 and 806 of the first channel 802. Thus, the elongate protrusions 614 and 616 of the housing 602 of LED light assembly 600 mates with a first channel 802 of the channel system 800 (FIGS. 14A and 14B) according to the present invention. The first channel 802 has corrugated sides 804 and 806 defining upper recesses 808 and 810 configured to receive and retain in a snap-fit manner the protrusions 614 and 616. Thus, the light assembly 600 can be snapped into the first channel 802 prior to installation to hold the light assemblies 600 in place while the first track 802 is being coupled to the second track 820. The second track 820 also has corrugated sides 822 and 824 configured to fit within the sides 804 and 806 of the first channel 802 with the recesses 822' and 824' engaging the corresponding inward protrusions 804' and 806' of the first channel 802 as shown in FIG. 14B. As such, when installing the tracks 700 and 800 containing the LED lights 600, the lights will not be able to fall from the channels 702 and 802 while it is being mated to the channels 720 and 820, respectively. The second channels 720 and 820 are configured to be mounted to a structure, such as an eave of a house by using threaded fasteners, staples, adhesives or other materials known in the art. The channels 702, 720, 802 and 820 are formed from aluminum that is bent to the configurations shown in FIGS. 13A-14B. Once mated, the two channels 702 and 720 and 802 and 820 snap together, but can be separated to remove the second channel if necessary in the rare event that a repair of the LED lights is necessary.

There is thus disclosed an improved lighting system, method of using the improved lighting system and installing the improved lighting system. In the foregoing specification, the present invention has been described with reference to specific exemplary embodiments. Various modifications and changes may be made, however, without departing from the spirit and scope of the present invention as set forth in the claims, including combinations of elements of the various illustrated embodiments. The specification and figures are illustrative, not restrictive, and modifications are intended to be included within the scope of the present invention. Accordingly, the scope of the present invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The phrase "consisting essentially of" as used herein is intended to cover additional elements or functions that do not materially affect the basic and novel characteristics of the claimed invention. Thus, "consisting essentially of" is intended to encompass not only those components specifically listed, but also separate or additional components that do not materially alter the specifically recited functions or elements.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

The invention claimed is:

1. A lighting system, comprising:

a first elongate channel configured for mounting to a structure;

a second elongate channel having a length approximately equal to a length of the first elongate channel removably coupled to the first elongate channel and forming a substantially enclosed elongate space between the first and second elongate channels, the second elongate channel having a plurality of evenly spaced holes therein;

a plurality of LED light assemblies coupled to the second elongate channel, each having a water-tight housing having a translucent portion containing a pair of programmable RGB LEDs and having a translucent lens exposed through one of the plurality of evenly spaced holes in the second elongate channel so that light from the pair of programmable RGB LEDs passes through the translucent lens;

a plurality of segments of wire, the plurality of segments of wire electrically connecting each of the LED light assemblies in series; and an LED light controller electrically connected to one of the plurality of segments of wire to individually control each programmable RGB LED of the pair of programmable RGB LEDs in the series and to provide power to each pair of programmable RGB LEDs in the series, the LED light controller having a plurality of functions, the plurality of functions comprising at least one of a desired light color for each programmable RGB LED, a duration of illumination for each programmable RGB LED or timing of illumination for each programmable RGB LED.

2. The lighting system of claim 1, wherein each of the plurality of LED light assemblies comprises an integrated circuit electrically coupled to and controlling the pair of programmable RGB LEDs associated therewith and wherein the LED light controller controls the integrated circuit to change at least one of the desired light color, the duration of illumination or the timing of illumination of the pair of programmable RGB LEDs associated with the integrated circuit.

3. The lighting system of claim 1, wherein each of the plurality of LED light assemblies further comprises a voltage regulator to limit a voltage drop through the pair of programmable RGB LEDs associated therewith.

4. The lighting system of claim 3, wherein the voltage regulator is a fixed frequency DC/DC converter.

5. The lighting system of claim 3, wherein the voltage regulator provides enough current to illuminate the associated pair of programmable LEDs while passing the remaining current to the next voltage regulator in the series.

6. The lighting system of claim 3, wherein each of the pair of programmable LEDs is configured to operate on a lower voltage than a higher voltage provided by the controller.

7. The lighting system of claim 1, wherein the first and second elongate channels interlock.

8. The lighting system of claim 7, wherein the second elongate channel defines a pair of inner recesses for receiving and retaining therein a corresponding pair of protrusions on an outer surface of each water-tight housing.

9. The lighting system of claim 8, wherein the first elongate channel has first and second side walls defining first and second elongate recesses, respectively, extending an entire length of the first elongate channel and the second elongate channel has first and second side walls defining first and second elongate recesses, respectively, extending an entire length of the second elongate channel, the first and second side walls of the first elongate channel engaging with inner surfaces of the first and second side walls of the second elongate channel so that the first and second elongate recesses of the first elongate channel are substantially aligned with the first and second elongate recesses of the second channel.

10. The lighting system of claim 1, wherein each series of the plurality of light assemblies comprises a female connector attached to one segment of wire at a first end of the series and a male connector attached to another segment of wire at a second end of the series, the female and male connectors forming a water tight seal when coupled to another respective male or female connector.

11. A method of installing a lighting system, comprising:

attaching a first elongate channel to a structure;

coupling a plurality of LED lights connected in series to a second elongate channel, each of the plurality of LED lights comprising a water-tight housing with a translucent portion containing at least one LED and a circuit, each of the translucent portions of the water-tight housings exposed through corresponding apertures in the second elongate channel, the plurality of LED lights connected in series by a plurality of segments of wire;

attaching the second elongate channel to the first elongate channel to form a substantially enclosed elongate space between the first and second elongate channels, the second elongate channel configured to be selectively removable from the first elongate channel; and electrically connecting a controller to a first end of a segment of wire that is coupled at a second end to one of the plurality of LED lights, the controller configured to individually communicate with each of the plurality of circuits of the plurality of LED lights in the series and for providing power to each of the plurality of LED lights in the series, the controller having a plurality of programmable functions comprising at least one of a light color for each of the plurality of LED lights, a duration of illumination for each of the plurality of LED lights or timing of illumination for each of the plurality of LED lights.

12. The method of claim 11, wherein each of the plurality of LED lights comprises an integrated circuit and further comprising controlling the integrated circuit with the controller to change the at least one of a light color for each of the plurality of LED lights, a duration of illumination for each of the plurality of LED lights or timing of illumination for each of the plurality of LED lights with the integrated circuit.

13. The method of claim 11, further comprising limiting a voltage drop through each of the plurality of LED lights with a plurality of voltage regulators, each associated with one of the plurality of LED lights.

14. The method of claim 13, wherein the voltage regulator is a fixed frequency DC/DC converter.

15. The method of claim 13, wherein the voltage regulator provides enough current to illuminate each LED light in the series while passing the remaining current to the next voltage regulator in the series.

16. The method of claim 13, wherein each of the plurality of LED lights is configured to operate on a lower voltage than a higher voltage provided by the controller.

17. The method of claim 11, further comprising interlocking the second channel with the first channel.

18. The method of claim 17, further comprising receiving and retaining a pair of protrusions on an outer surface of each water-tight housing within a corresponding pair of inner recesses in the second elongate channel.

19. The lighting system of claim 18, wherein the first elongate channel has first and second side walls defining first and second elongate recesses, respectively, extending an entire length of the first elongate channel and the second elongate channel has first and second side walls defining first and second elongate recesses, respectively, extending an entire length of the second elongate channel, the first and second side walls of the first elongate channel engaging with inner surfaces of the first and second side walls of the second elongate channel so that the first and second elongate recesses of the first elongate channel are substantially aligned with the first and second elongate recesses of the second channel.

20. The lighting system of claim 11, wherein each series of the plurality of LED lights comprises a female connector attached to one segment of wire at a first end of the series and a male connector attached to another segment of wire at a second end of the series, the female and male connectors forming a water tight seal when coupled to another respective male or female connector.

* * * * *